US012127637B1

(12) United States Patent
Levy

(10) Patent No.: US 12,127,637 B1
(45) Date of Patent: Oct. 29, 2024

(54) ZIPPER SHIELD

(71) Applicant: Peter L. Levy, San Francisco, CA (US)

(72) Inventor: Peter L. Levy, San Francisco, CA (US)

( * ) Notice: Subject to any disclaimer, the term of this patent is extended or adjusted under 35 U.S.C. 154(b) by 0 days.

(21) Appl. No.: 18/746,462

(22) Filed: Jun. 18, 2024

(51) Int. Cl.
*A44B 19/26* (2006.01)
*A44B 19/08* (2006.01)

(52) U.S. Cl.
CPC ..... *A44B 19/08* (2013.01)

(58) Field of Classification Search
CPC ..... A44B 19/08
See application file for complete search history.

(56) References Cited

U.S. PATENT DOCUMENTS 3,490,109 A * 1/1970 Heimberger ..... A44B 19/32 24/389
6,571,432 B1 * 6/2003 Rindle ..... A41F 1/00 24/389
8,499,422 B2 * 8/2013 Jacobsen ..... A44B 19/34 24/384
2005/0050698 A1 * 3/2005 Muratsubaki ..... A44B 19/262 24/429
2005/0115032 A1 * 6/2005 Chou ..... A44B 19/00 24/381
2006/0204147 A1 * 9/2006 Stolmeier ..... B65D 33/2508 24/399
2008/0229555 A1 * 9/2008 Keyaki ..... A44B 19/308 24/429
2014/0359978 A1 * 12/2014 Wang ..... A44B 19/32 29/408
2015/0201717 A1 * 7/2015 Bliss ..... A44B 19/34 24/418
2016/0198812 A1 * 7/2016 Tan ..... A44B 19/22 24/389
2019/0357638 A1 * 11/2019 Sho ..... A44B 19/28

* cited by examiner

*Primary Examiner* — Jason W San
(74) *Attorney, Agent, or Firm* — Walt Froloff

(57) ABSTRACT

A jam proof zipper device is as described having a shield component coupled to the slider which clears a zipper slider channel entry profile such that all but the tape teeth elements enter or exit the slider channels by steering any encroaching cloth, tape or material away from entering the Y-shaped channel entrance.

11 Claims, 4 Drawing Sheets

ZIPPER SHIELD

BACKGROUND

Field of the Invention

The present invention relates generally to improvements in the common zipper consumer device. More particularly, the invention relates to an improved form of a zipper device which prevents jamming, snagging or locking.

Background of the Invention

The most ubiquitous closure device is probably known by the name of zipper. The patent for this device was issued in 1917 to Sundback. In 1923 Winterhalter used ribs and grooves instead of jaws to close the device and that forms the basic mechanism of the zipper to this day. There are a number of types of zippers: Coil, zippers with invisible teeth where the teeth are hidden behind a tape, reverse coil zippers, reverse coil, plastic-molded, open-ended, two way open-ended, two way closed-ended, and magnetic.

The common material to make zippers using metal, are brass, aluminum and nickel. The other common material is molded plastic using thermoplastic polymers such as polyethylene. Since the 1950's zipper patents have essentially been centered on improving the slider lock portion of the zipper. That is the terminal ends of the zipper. The one area that has been overlooked is solving the problem of the cloth binding with the zipper and immobilizing the mechanism. This is an important problem especially in items where the cloth, leather or other material overlaps the zipper track. But during closure or opening of the zipper items such as in sleeping bags, flight jackets and items where it is important to cover the zipper part to keep the wearer warm, the zipper cover to zipper tape engage in the zipper slider with the zipper elements.

The zipper was created for other items but its largest application is garments. In many garments, the zipper opening is closed completely when the slider is at the top end. Some garments have double-separating zippers with two sliders on the tape. When the sliders are on opposite ends of the tape, the garment is closed. If the lower slider is raised then the bottom part of the garment may be opened to allow more comfortable sitting or bicycling. When both sliders are lowered then the zipper may be totally separated. None of these zipper permutation and innovations address the potential for material zipper snagging and jamming the slider.

A zipper is often a small cost relative to the entire garment, but when it fails or is damaged, the article may be unusable until the zipper is repaired or replaced, which can be difficult and expensive. Problems often lie with the zipper slider; when it becomes worn it does not properly align and join the alternating teeth. With separating zippers, the insertion pin may tear loose from the tape; the tape may even disintegrate from use. If a zipper fails, it can either jam or partially break off. At times, the zipper tape or zipper cover cloth can become lodged in the slider and lock or jam up preventing the slider movement in either direction.

What is needed are zippers that do not catch, jam or snag on the surrounding zipper cover cloth, tape, inner liner or other garment or zipper components. What is needed are zippers that do not lock, snag, or jam up, preventing their use and or requiring their replacement to an otherwise unusable garment.

SUMMARY

The present invention discloses a jam proof zipper device made with a slider fastener mounted on two tracks of teeth elements, with the two tracks of teeth elements each coupled to a tape strip. Each tape strip has teeth elements conformably interlocking with adjacent and opposite teeth elements when pressed together through the slider fastener. The slider fastener has a Y-shaped channel which, as in typical zipper fashion, is activated by moving the tape strip relative and through the Y-shaped channel the two tracks of teeth elements interlock or decouple the two tracks of meshed teeth on the tape strips as they enter or exit the slider Y-channel causing the two tape strips to be coupled or uncoupled respectively, and at least one shield component is coupled to the slider extending beyond the slider Y-shaped channel opening and also extending beyond the back of the slider, the shield component also extends laterally out and over the two rows of pre-entered channel teeth elements. In this way the zipper slider with shield component clear zipper slider channel entry areas such that all but the tape teeth elements enter or exit the slider channels by steering any encroaching cloth, tape or material away from entering the Y-shaped channel entrance.

BRIEF DESCRIPTION OF DRAWINGS

Specific embodiments of the invention will be described in detail with reference to the following figures.

DETAILED DESCRIPTION

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Objects and Advantages

An object of the invention is to provide a zipper that does not snag or lock during operation.

Another object of the invention is to extend non-jamming zipper use to a variety of markets including sleeping bags, luggage, vehicle tops, tents, camping and outdoor equipment, leather garments, cloth garments, and others.

Yet Another object of the invention is prevent a zipper from damage to a garment which is then rendered useless.

Another object of the invention is to create zippers that do not catch, jam or snag on the surrounding zipper cover cloth, tape, inner liner or other garment or zipper components.

The present invention discloses several embodiments for making a zipper with a non-jamming non-snagging, non-catching character.

Figure 1:
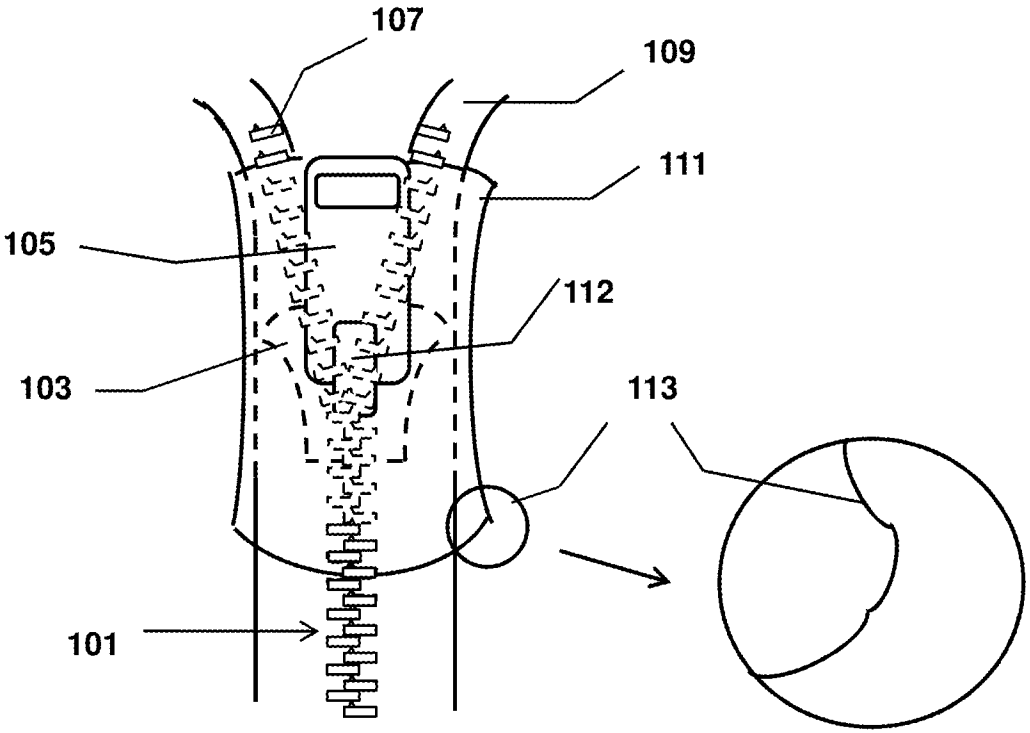
FIG. 1 illustrates a top view of a zipper shield on a typical zipper in an embodiment of the invention.

FIG. 1 illustrates a top view of a zipper shield on a typical zipper in an embodiment of the invention.

An embodiment of a jam proof zipper device comprises a slider fastener 103 mounted on two tracks of teeth elements 107, the two tracks of teeth elements are each coupled to a tape strip 109. Each tape strip 109 has two sides, an inside and outside and with teeth elements 107 on the edge which are conformably interlocked or meshed with adjacent and opposite teeth elements when pressed together through the slider fastener 103, not unlike a typical zipper. The slider fastener 103 front end has a Y-shaped channel which is activated by moving the tape strip 109 relative and through the slider fastener 103 Y-shaped channel the two tracks of teeth elements 107 interlock or decouple the two tracks of teeth on the tape strips as they enter or exit the slider Y-channel causing the two tape strips to be coupled 101 or uncoupled respectively. At least one shield component is 111 coupled to the slider 103 extending before the slider Y-shaped channel opening and also extending beyond the back of the slider 103. The shield component 111 also extends laterally out and over the two rows of pre-entered channel teeth elements 107 101.

The slider fastener 103 is coupled to a pull tab connector 112 which is in rotatable coupled to a pull tab 105. Zipper jamming is prevented when the zipper slider 103 in concert with shield component 111 clear zipper slider channel frontal entry areas such that all but the tape teeth elements 107 enter or exit 101 the slider 103 channels, steering any encroaching cloth, tape or material away from entering the Y-shaped channel entrance or the slider back entrance.

There is a rounded edge at each corner 113 of the zipper shield 111 and in some embodiments the radius of each rounded corner is greater than the distance between each track of the zipper so that the end portion of the shield 111 doesn't get stuck on the zipper tracks 107 101. In some embodiments the zipper shield components 111 must extend out from the slider and just touch and glide over the zipper tape 109 or host cloth.

Figure 2:
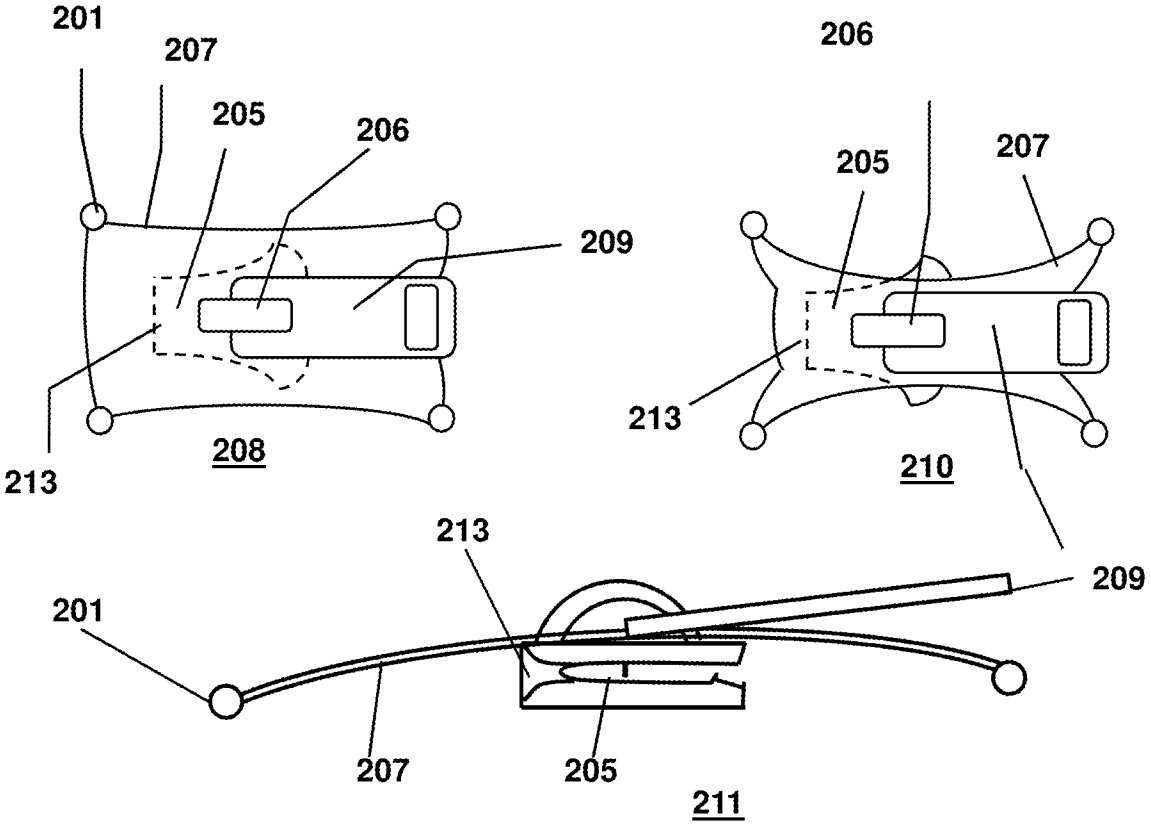
FIG. 2 shows top and side views of a zipper shield shape in embodiments of the invention.

FIG. 2 shows top and side views of a zipper shield shape in embodiments of the invention.

In order for the zipper shield to work against catching on or jamming on the surrounding zipper cover cloth, tape, inner liner or other garment or zipper components the zipper shield can have various shape requirements and tolerances in alternate embodiments. Two different zipper shield component shapes 208 210 are shown from the top view here. A shield component 207 profile view is also shown 211. In the profile view the shield curved surface is depicted as curving toward a tape having rounded edge corners 201 for riding proximate if not touching the tape to clear zipper element entrance profiles to a minimum.

Two embodiments of a jam proof zipper device shield 107 shapes are shown with the shield 207 shape having a surface extending forward and backward from the slider 205 entrance 213 and also curved outward of the slider 205 laterally and toward the zipper tape, the surface having rounded corners 201 for holding in proximity with the zipper tape and teeth elements. The zipper device slider 205 component, is shown coupled to a pull tab 209 via a pull tab connector 206 in typical zipper fashion.

In an embodiments is a small sphere-like shield corner 201 at each corner each sphere extends out away from each zipper element track. In an embodiment the smooth shield corners 201 just touch and glide over the zipper tape just outside the teeth providing no or little additional clearance for non-zipper elements into the slider entrance or exit.

Figure 3:
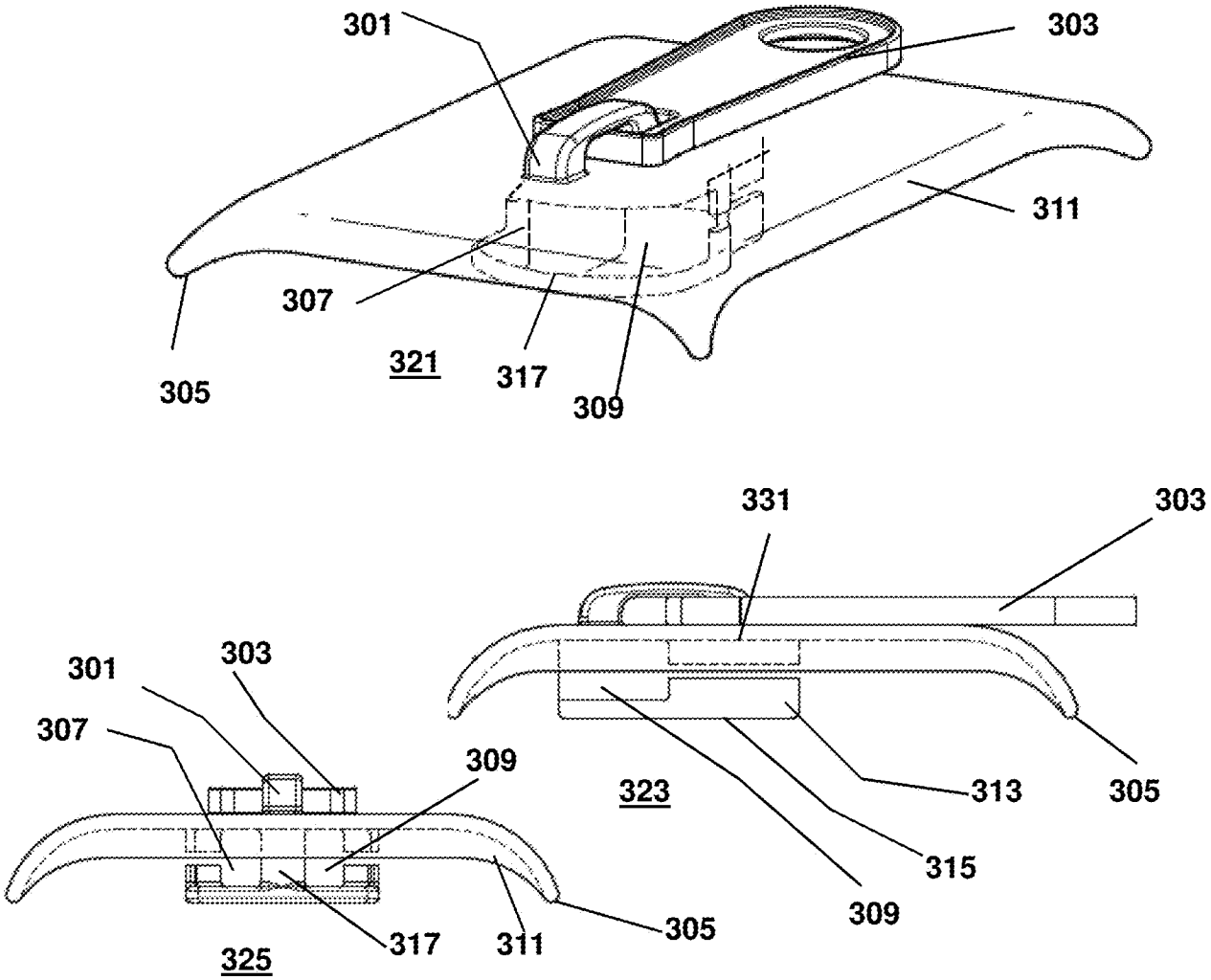
FIG. 3 displays a front, side and perspective views of a jam-proof zipper device in an embodiment of the invention.

FIG. 3 displays a front 325, side 323 and perspective 321 views of a jam-proof zipper device in an embodiment of the invention.

A jam proof zipper device embodiment is shown with a classic zipper having a slider 313 fastener with at least one shield component 311. The at least one shield component 311 is firmly coupled to the slider fastener top 313, shield component 311 is shaped as a curved surface bounded by closed polygon with smooth corners 305. The shield component 311 shape curved surface extending beyond a slider front end 317 Y-shaped channel opening 307 309 and also extending beyond back-end 313 of the slider channel, the shield component 311 may extend laterally out and over two parallel rows of pre-entered Y-channel 307 309 teeth elements. The zipper slider 317 with shield component 311 minimize zipper slider Y-channel entry to all but the tape teeth elements, which enter or exit the slider channels 307 309 313 by shield steering encroaching cloth, tape or material away from entering the Y-shaped channel slider entrance with the exception of the tape teeth, thus insuring the absence of jamming or snagging of material or entities not zipper teeth.

In another aspect of the invention a sphere to smooth out each corner 305 of the zipper shield 311 slides on the track of the zipper so that the end portion of the shield don't snag or get stuck on the zipper tracks, tape or zipper covering material.

The shield corners 305 are proximate and glide over a zipper tape, the shield is firmly coupled to the top 311 of the slider, extending forward/backward of the slider Y-opening 307 309 to prevent all other objects from getting tangled with the zipper elements in front or behind of the slider.

Figure 4:
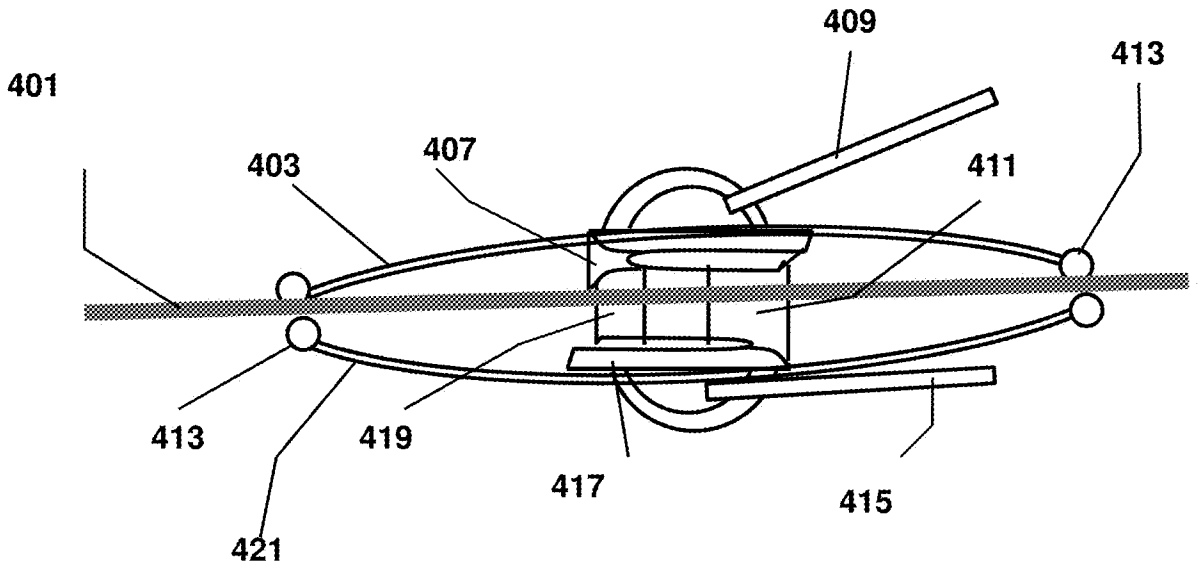
FIG. 4 shows a zipper device profile view with a slider fastener having two sided zipper shield in an embodiment of the invention.

FIG. 4 shows a zipper device profile view with a slider fastener having two sided zipper shield in an embodiment of the invention.

In some products zippers must function or be operated from the inside and outside of the material enclosure, as for example sleeping bags or tents. In these situations a zipper will have pull tabs on both sides of the barrier, material or cloth to be closed or opened. The jam proof zipper device further comprises a slider fastener with zipper shields on both top 407 and bottom 421 zipper shield having an independent pull tab 409 415 providing the option of using the zipper from inside or outside of a zipper held barrier.

In this embodiment a slider fastener has two shields, a top shield 403 coupled to the slider top 407 and a bottom shield 421 coupled to the slider bottom 417. The top shield 403 and the bottom shield 421 loosely hold the tape with the teeth elements 401 between them such that the tape with elements 401 enters the slider Y-channel entrance 419 profile from a cleared profile allowing not much clearance for anything aside from the zipper tape with teeth elements 401 and in similar fashion clears the channel exit 411 profile. As in other embodiments, the shield corners 413 will be smooth to eliminate snagging or puncturing the tape 401 or surrounding cloth or material.

Therefore, while the invention has been described with respect to a limited number of embodiments, those skilled in the art, having benefit of this invention, will appreciate that other embodiments can be devised which do not depart from the scope of the invention as disclosed herein. Other aspects of the invention will be apparent from the following description and the appended claims.

What is claimed is:

1. A jam proof zipper device comprising:

a slider fastener mounted on two tracks of teeth elements, the two tracks of teeth elements each coupled to a tape strip;

each tape strip having teeth elements conformably interlocking with adjacent and opposite teeth elements when pressed together through the slider fastener;

the slider fastener has a Y-shaped channel which is activated by moving the tape strip relative and through the Y-shaped channel the two tracks of teeth elements interlock or decouple the two tracks of meshed teeth on the tape strips as they enter or exit the slider Y-channel causing the two tape strips to be coupled or uncoupled respectively, and at least one shield component coupled to the slider extending beyond the slider Y-shaped channel opening and also extending beyond the back of the slider, the shield component also extending laterally out and over the two rows of pre-entered channel teeth elements whereby the zipper slider with shield component clear zipper slider channel entry areas such that all but the tape teeth elements enter or exit the slider channels by steering any encroaching cloth, tape or material away from entering the Y-shaped channel entrance.

2. The jam proof zipper device as in claim 1 further comprising the shield component with a surface curved shape extending proximate to the zipper tape.

3. The jam proof zipper device as in claim 1 further comprising the shield with a surface curved toward the zipper tape, the surface having rounded corners for sliding on the zipper tape.

4. The jam proof zipper device as in claim 1 further comprising the zipper device is made essentially from materials including metal, plastic and composites.

5. The jam proof zipper device as in claim 1 further comprising the slider fastener with zipper shields on both top and bottom of the zipper slider having an independent pull tab allows the user the option of using the zipper from inside or outside of a zipper.

6. A jam proof zipper device comprising:

a zipper having a slider fastener firmly coupled to at least one shield component;

at least one shield component is firmly coupled to the slider fastener top, with the shield component extending beyond the slider in the lateral direction toward the zipper tape and shaped as a curved surface bounded by closed polygon with smooth corners, and the shield component shape curved surface extending beyond a slider front end Y-shaped channel opening and also extending beyond back-end of the slider channel, the shield component also extending laterally out and over the two rows of pre-entered slider channel teeth elements, whereby the zipper slider with shield component clear zipper slider channel entry profile such that all but the tape teeth elements enter or exit the slider channels by shield steering encroaching cloth, tape or material away from entering the Y-shaped channel slider entrance.

7. A method for a jam proof zipper device comprising the steps of:

mounting a slider fastener on two tracks of teeth elements, the two tracks of teeth elements each coupled to a tape strip;

conformably interlocking each tape strip having teeth elements with adjacent and opposite teeth elements when pressed together through the slider fastener;

moving the slider fastener Y-shaped front-end over the tape strip two tracts relative and through the Y-shaped slider channel with two tracks of teeth elements to interlock or decouple the two tracks of teeth on the tape strips as they enter or exit the slider Y-channel causing the two tape strips to be coupled or uncoupled respectively, and providing at least one shield component coupled to the slider extending beyond the slider Y-shaped channel opening and also extending beyond the back of the slider, the shield component also extends laterally out and over the two rows of pre-entered channel teeth elements whereby the zipper slider with shield component clear zipper slider channel entry areas such that all but the tape teeth elements enter or exit the slider channels by disallowing any encroaching cloth, tape or material proximate to the zipper tape away from entering the Y-shaped channel entrance.

8. The method for a jam proof zipper device as in claim 7 further comprising the step of:

providing the shield component with a surface curved shape extending proximate to the zipper tape.

9. The method for a jam proof zipper device as in claim 7 further comprising the steps of:

providing the zipper shield with a surface curved toward the zipper tape, the surface having rounded corners for sliding over the zipper tape.

10. The method for a jam proof zipper device as in claim 7 further comprising the steps of:

providing the zipper device is made essentially from materials from a set of materials including metal, plastic and composites.

11. The method for a jam proof zipper device as in claim 7 further comprising the steps of:

providing a slider fastener with zipper shields on both top and bottom zipper shield having an independent pull tab for use of the zipper from both sides of a zipper tape.

* * * * *